US006599228B2

(12) United States Patent
Hailey et al.

(10) Patent No.: US 6,599,228 B2
(45) Date of Patent: Jul. 29, 2003

(54) DEVICE FOR BATCH PRODUCTION OF FOLDED SHEETS

(75) Inventors: Kerri Crain Hailey, Cincinnati, OH (US); Jonathan Paul Brennan, Cincinnati, OH (US); David A. Harnish, Maysville, KY (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/308,469

(22) Filed: Dec. 3, 2002

(65) Prior Publication Data

US 2003/0078148 A1 Apr. 24, 2003

Related U.S. Application Data

(63) Continuation of application No. 09/633,974, filed on Aug. 8, 2000.

(51) Int. Cl.[7] ..... B31F 1/00

(52) U.S. Cl. ..... 493/405; 493/416; 493/436; 493/438; 493/439; 493/440

(58) Field of Search ..... 493/405, 416, 493/436, 438, 439, 440; 270/40, 41

(56) References Cited

U.S. PATENT DOCUMENTS

| | | | | | |
|---|---|---|---|---|---|
| RE12,204 | E | * | 3/1904 | Casterline | 270/40 |
| 1,425,071 | A | * | 8/1922 | Winter | 270/40 |
| 1,758,033 | A | * | 5/1930 | Dodge | 270/41 |
| 3,291,478 | A | * | 12/1966 | Couzens et al. | 270/40 |
| 3,307,844 | A | * | 3/1967 | Stults | 270/40 |
| 3,401,928 | A | * | 9/1968 | Frick | 270/40 |
| 3,472,504 | A | * | 10/1969 | Murphy et al. | 270/40 |
| 3,518,810 | A | * | 7/1970 | Steeves | 493/287 |
| 3,519,263 | A | * | 7/1970 | Frick | 270/40 |
| 3,707,281 | A | * | 12/1972 | Murphy et al. | 270/40 |
| 3,817,514 | A | * | 6/1974 | Nissen et al. | 270/40 |
| 3,834,689 | A | * | 9/1974 | Lee et al. | 493/440 |
| 6,238,328 | B1 | * | 5/2001 | Loppnow et al. | 493/440 |

* cited by examiner

*Primary Examiner*—John Sipos
*Assistant Examiner*—Louis Huynh
(74) *Attorney, Agent, or Firm*—Michael S. Kolodesh; Jay A. Krebs; Ken K. Patel

(57) ABSTRACT

A device and a method for producing a batch of products having a multiplicity of interfolded, generally rectangular sheets including wet wipes, from a limited amount of a web material, at a high production speed and in efficiently used floor space. The method includes the steps of folding a first and second ribbons by a first and second folding devices, respectively; interfolding the ribbons to provide a first pair of ribbons; securing the first pair to a perimeter surface of a cyclical accumulator; accumulating the first pair onto the perimeter surface by providing a tangential velocity to the first pair; interfolding the first pair with a newly formed second pair of ribbons; rotating the perimeter surface of the cyclical accumulator to provide the tangential velocity to the second pair so as to superimpose the second pair onto the first pair of ribbons; displacing the cyclical accumulator linearly to accommodate the second pair in a machine direction; repeating the steps of rotating and linearly displacing the cyclical accumulator to form successive pairs of ribbons until a desired stack of ribbons is accumulated on the perimeter surface; and selectively cutting through the stack of ribbons.

1 Claim, 17 Drawing Sheets

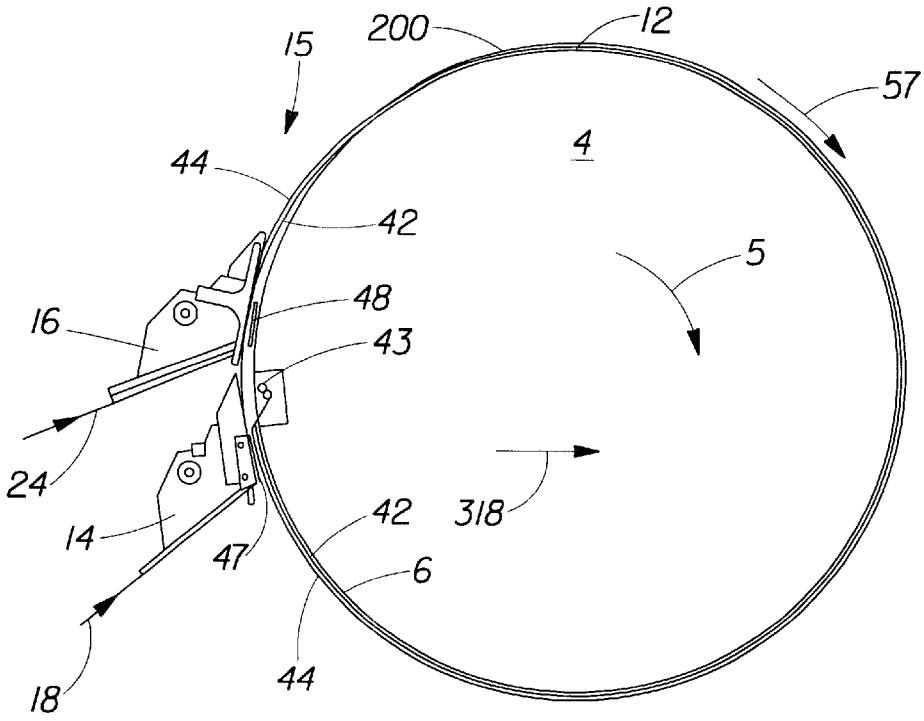
Fig. 3
Fig. 3A
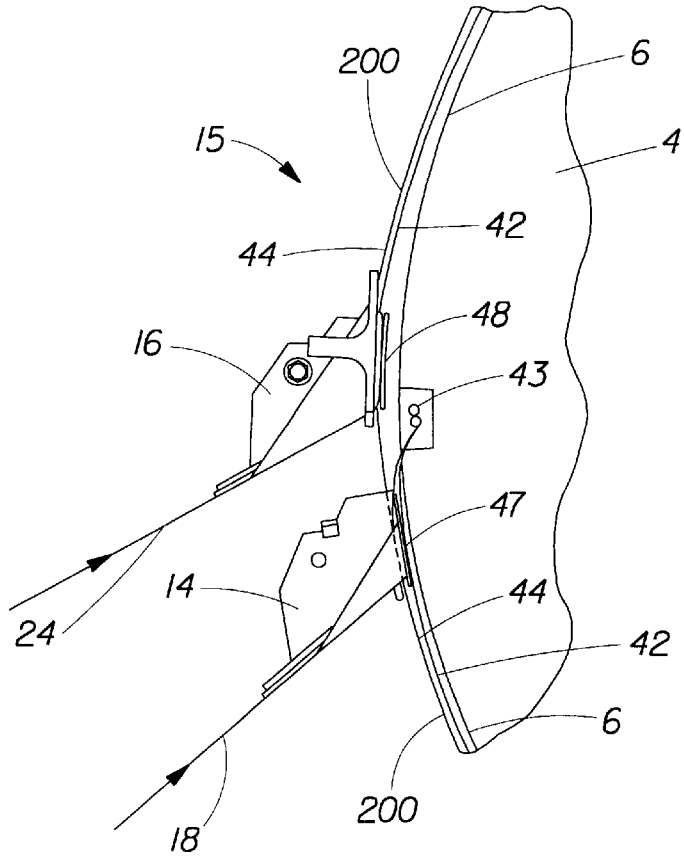

DEVICE FOR BATCH PRODUCTION OF FOLDED SHEETS

This is a continuation of application Ser. No. 09/633,974, filed Aug. 8, 2000.

FIELD OF THE INVENTION

The present invention relates to a method for producing stacks of folded sheets and, more particularly, for producing a batch of stacks of wet wipes from a limited amount of source material, at a high production speed and in efficiently used floor space.

BACKGROUND OF THE INVENTION

Wet wipes are typically pre-moistened, disposable towelettes which may be utilized in a variety of applications both domestic and industrial. One particular application is the use of wet wipes for wiping parts of the human body. Wet wipes may also be used for application of substances to the body including removing and applying of make-up, skin conditioners and medications. Another application of wipes is during diaper changes and also for the treatment of adult and baby dermatitis partly caused by the use of diapers and incontinence devices. In addition, wet wipes are also applicable for wiping and/or cleansing other surfaces or for the application of compositions to surfaces, for example, kitchen and bathroom surfaces, eyeglasses, shoes and surfaces which require cleaning in industry, for example, surfaces of machinery or automobiles. Wet wipes can also include articles used for the cleaning or grooming of pets.

Wet wipes are commonly constructed of combinations of synthetic and natural fibers, such as polyolefin fibers, viscose fibers and cotton fibers formed into what is commonly referred to as a web. The webs are generally moistened with an aqueous composition which can contain surfactants, preservatives, oils and scents. The wet wipes are then typically provided in a stack, wherein each of the wet wipes in the stack have been arranged in a folded configuration, such as a z-folded, c-folded, quarter-folded or other configurations. Pop-up wet wipes in which the wet wipes are interfolded with the wet wipes immediately above and below in a stack of wipes are also known to those skilled in the art. The conventional packages are often moisture-proof containers including stacks of discrete wipes, and are typically designed to provide one at a time dispensing which can be accomplished by using a single hand. The containers may have a lid and/or a dispensing aperture.

Automated methods for folding a series of continuous webs into a ribbon of overlapping sheets for use in a pop-up dispensing system, often referred to as interfolding, are known to the art. One method of interfolding is typically performed in a continuous fashion, wherein a multiplicity of webs is provided in a form of multiple parent rolls and wherein each web contributes to one wipe in the stack of wipes. The plurality of webs are normally unwound from the parent rolls by use of unwind stands and dragged through a plurality of folding devices, wherein each folding device is dedicated to folding a particular web. One difficulty with such type of processes is to maintain precise fold dimensions throughout the stack with the large number of individual folding devices, 10 to 80 folding devices, to make accordingly a typical 10 to 80 count stack of individual wipes. Further, such processes employing a large number of folding devices often require relatively high capital investment. Another difficulty with the multiple-web-type processes is to produce a limited size batch of wet wipe products for development purposes without providing a multiplicity of webs, and, thus avoiding the high cost of materials. Still another problem with such processes is that they require a lot of floor space to accommodate the multiplicity of webs and folding devices.

Another method of interfolding utilizes typically two webs which are folded and interfolded by a pair of rotating rolls. A tucker member and vice or suction rolls are typically used to alternatively and transversely fold each piece of web in an intermeshing relation to its immediately preceding piece and its immediately succeeding piece. Although such a method provides more effective use of materials for a limited size batch production, however, these processes are complex and, accordingly, are expensive to manufacture and maintain.

Another problem which particularly relates to the folding of wet webs at high production speeds is the use of conventional folding devices. The conventional folding devices, such as a folding device described in U.S. Pat. No. 4,131,271, often do not work as effectively with wet webs as they do with dry webs at high production speeds. The problems may include wrinkles in the folds and tears of the webs.

Accordingly, it would be desirable to provide a method which is cost effective to produce a limited size batch of wet wipe at high production speed. Further, it would be desirable to provide a method which can be utilized in an efficient floor space. Further, it would be desirable to provide a method which does not require a supply of multiple web materials. Further, it would be desirable to provide a method which does not require use of multiple folding devices. Still further, it would be desirable to provide a folding device that works efficiently with wet web materials at high production speeds.

SUMMARY OF THE INVENTION

In accordance with one aspect of the present invention, a method is provided for producing a batch of products having a multiplicity of interfolded, generally rectangular sheets from webs having an advancing velocity in a path of travel of each web. The method includes the steps of folding a first ribbon by feeding a first web in the path of travel of the first web through a first folding device capable of making a longitudinal Z-fold. The Z-fold includes an upper fold portion having an upper width, a middle fold portion underlying the upper fold portion and having a middle width and a lower fold portion underlying the middle fold portion and having a lower width. The method further includes the step of folding a second ribbon by feeding a second web in the path of travel of the second web through a second folding device capable of making a longitudinal Z-fold. The method further includes the step of interfolding the first ribbon with the second ribbon by inserting at least one portion of the first ribbon through an interfolding gap in the second folding device to form a first pair of ribbons, wherein the first ribbon is at least partially overlapped with the second ribbon. The method further includes the step of securing the first pair of ribbons to a perimeter surface of a cyclical accumulator positioned adjacent to the first folding device. Further, the method includes the step of accumulating the first pair of ribbons onto a perimeter surface of the cyclical accumulator by providing a tangential velocity to the first pair of ribbons in a path of travel thereof coinciding with the path of travel of the first ribbon and the path of travel of the second ribbon. The tangential velocity being substantially equal to the advancing velocity of the first web and the second web. Further, the method includes the step of interfolding the first pair of ribbons with a second pair of ribbons by inserting at least one portion of the first pair of ribbons through an interfolding gap in the first folding device. Further, the method includes the step of accumulating the second pair of ribbons onto the perimeter surface of the cyclical accumulator by rotating the perimeter surface of the cyclical accumulator to provide the tangential velocity to a second pair of ribbons, wherein at least one portion of the second pair of ribbons is superimposed onto the first pair of ribbons. Further, the method includes the step of repeating the step of rotating the cyclical accumulator to form successive pairs of ribbons until a desired stack of pairs of ribbons is formed on the perimeter surface of the cyclical accumulator. The method further includes the step of selectively cutting through the stack of pairs of ribbons to provide a batch of products having a multiplicity of interfolded, generally rectangular sheets.

BRIEF DESCRIPTION OF THE DRAWINGS

FIG. 3 is an enlarged front elevational view of a cyclical accumulator in a second arresting position and two folding devices taken from FIG. 1, wherein the first pair of ribbons is accumulated on the peripheral surface of the cyclical accumulator, and the cyclical accumulator is in a position suitable for threading the first pair of ribbons through a first folding device.

FIG. 3A is a view similar to FIG. 3, showing the first pair of ribbon threaded through the first folding device.

DETAILED DESCRIPTION OF THE INVENTION

This invention relates to a method for a batch production of products having stacks of folded sheets, from limited quantities of web materials, in an efficiently used floor space and at high production speeds. The present invention may be useful for folding of any web material, dry or wet, having sufficient structural integrity to be processed as a continuous web. Non-limiting examples of such web materials may include non-woven substrates, facial tissues, papers, plastic films, foams, rubbers, metal foils and other materials, either separately or in combination, in single or multiple-layer forms. Further, the present invention may utilize one or any number of web materials simultaneously. However, for the purpose of simplicity, the invention will be described in terms of preferred and alternative embodiments for production of wet wipes from two non-woven web materials as shown in the figures herein.

Figure 1:
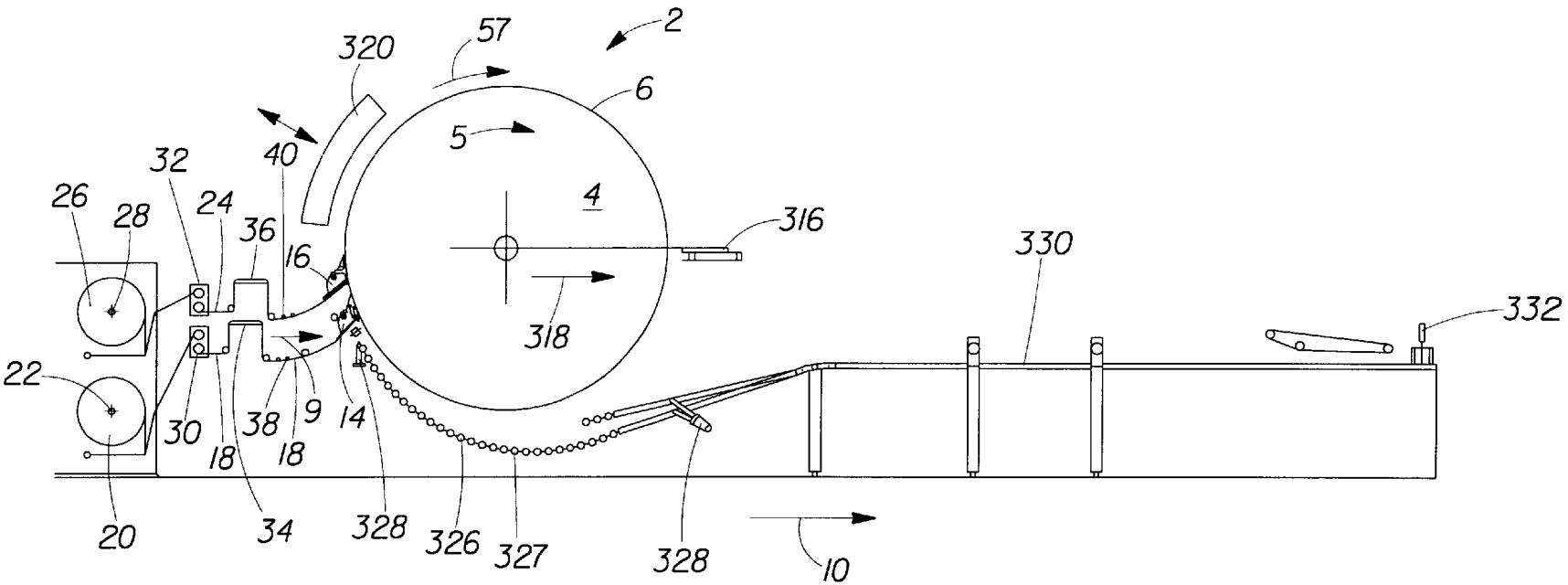
FIG. 1 is a simplified schematic front elevational view of a process for manufacturing a batch of products having a multiplicity of folded sheets in accordance with the present invention.
Figure 2:
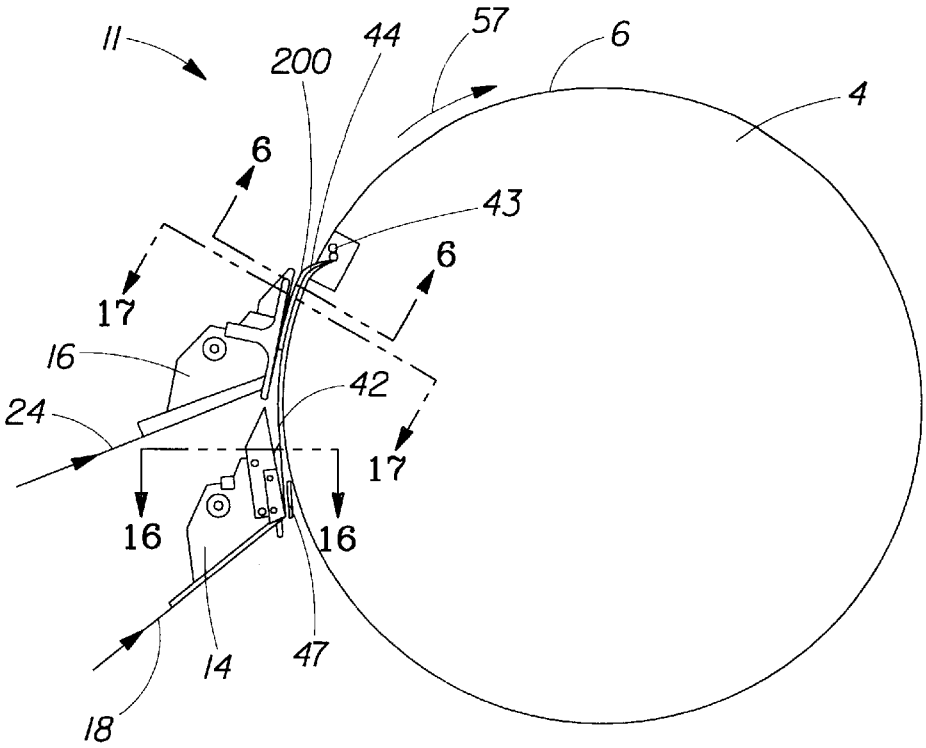
FIG. 2 is an enlarged front elevational view of a cyclical accumulator in a first arresting position and two folding devices taken from FIG. 1, wherein a first pair of ribbons is secured to a perimeter surface of the cyclical accumulator.
Figure 2A:
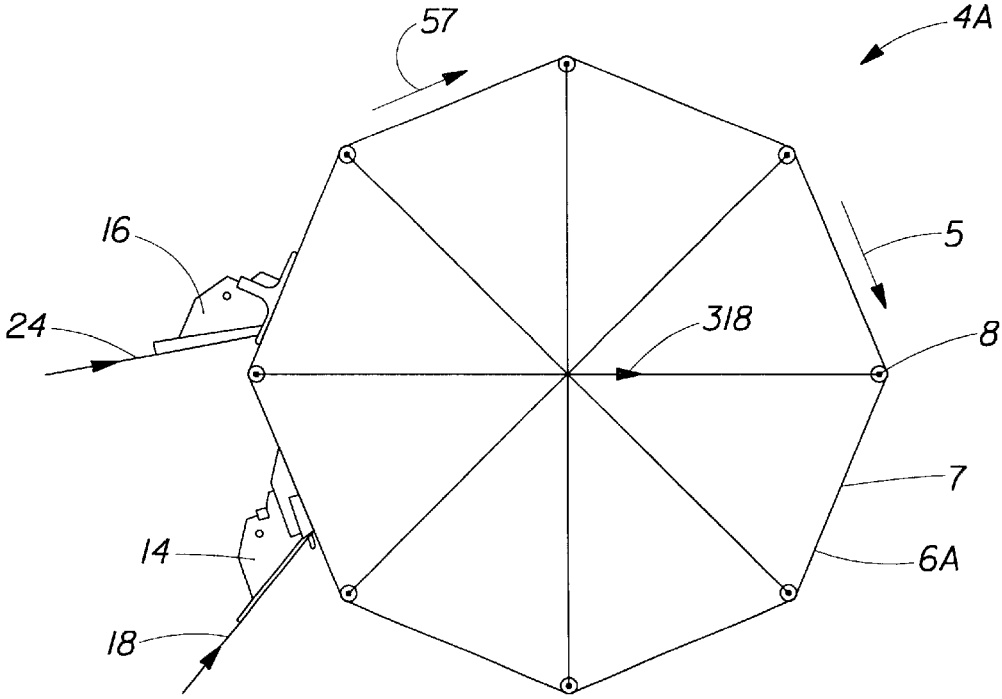
FIG. 2A is an enlarged front elevational view of an alternative embodiment of the cyclical accumulator.
Figure 2B:
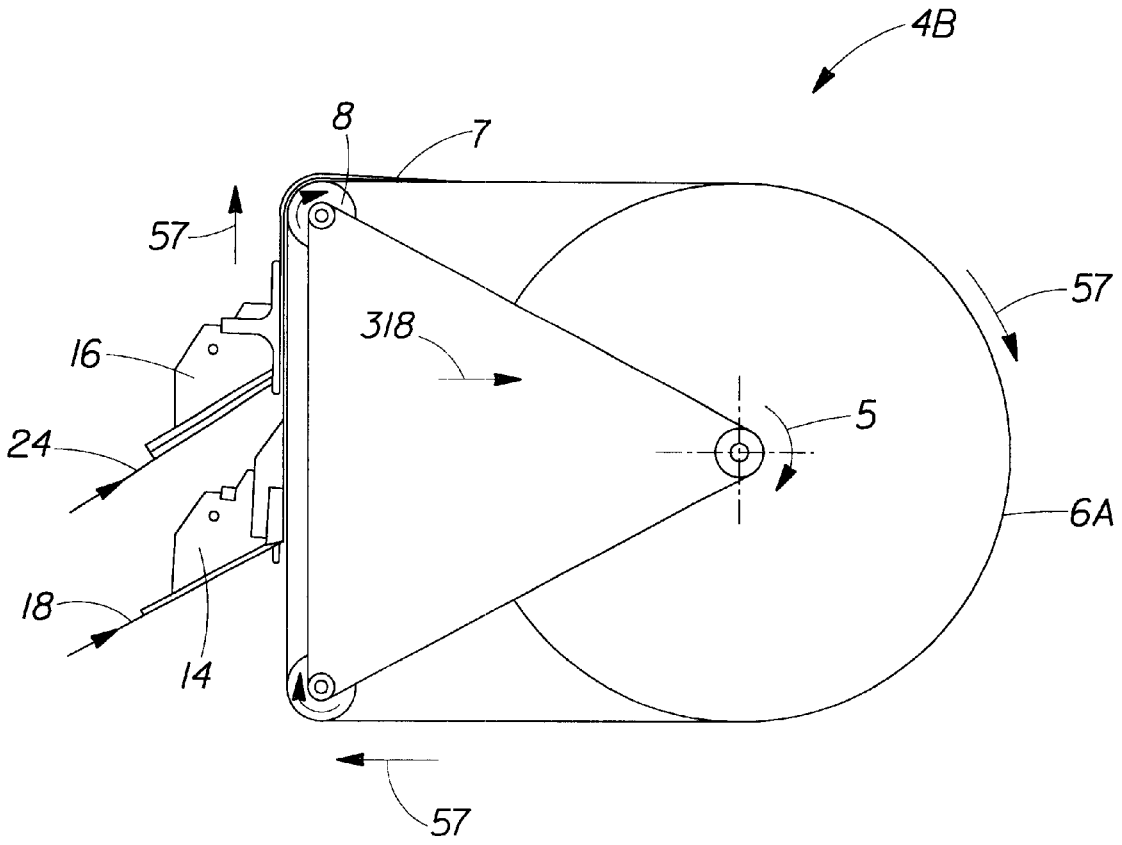
FIG. 2B is an enlarged front elevational view of another alternative embodiment of the cyclical accumulator.
Figure 20:
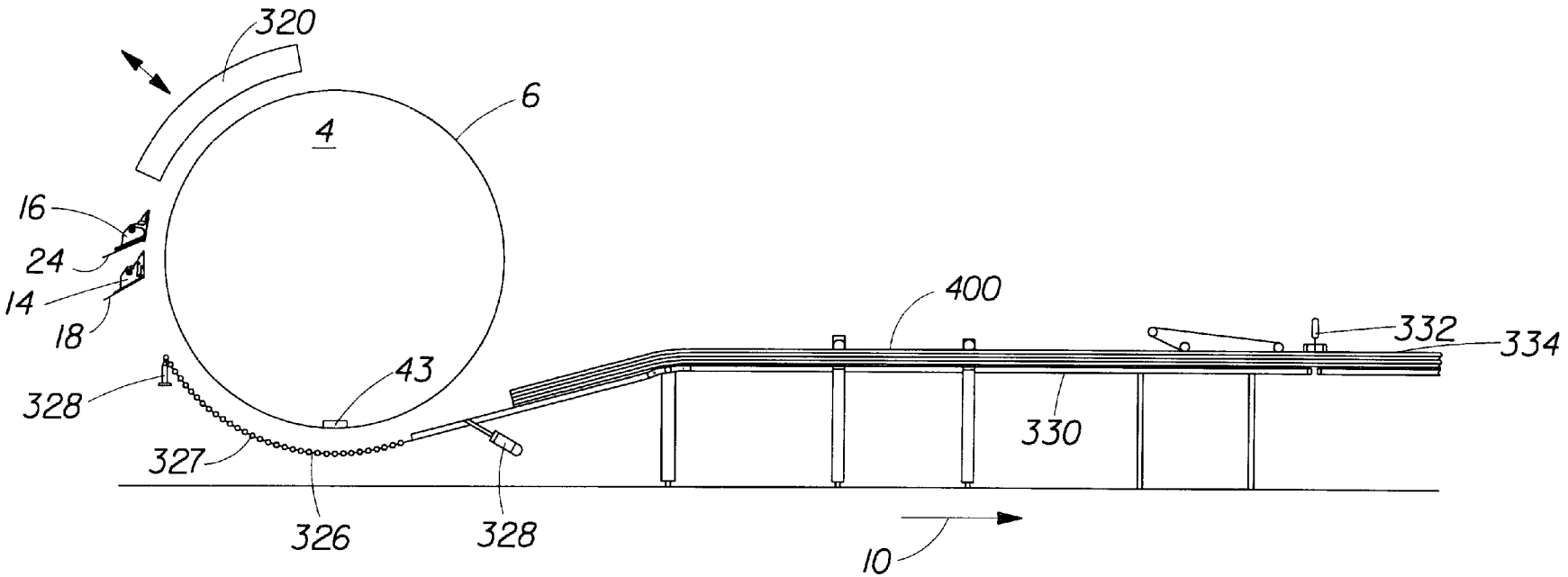
FIG. 20 is a simplified schematic front elevational view similar to FIG. 19, wherein the stack of ribbons is cut into stacks of wipes.

Referring now to the figures, FIG. 1 illustrates one embodiment of the present invention, wherein a machine 2 can be used to make a batch production of stacks of wet wipes (best shown in FIG. 20). The machine 2 comprises a cyclical accumulator 4 having a rotating perimeter surface 6. The cyclical accumulator 4 can be of any shape, including but not limited to round (as shown in FIGS. 1 and 2), triangular, square, hexagonal, an octagonal (as shown, for example, for a cyclical accumulator 4A in FIG. 2A) or other multi-sided shapes. Further, the perimeter surface 6 of the cyclical accumulator 4 can also include belts 7 or chains or the like, guided by pulleys 8 or sprockets or the like, to form the rotating perimeter surface 6A, as shown, for example, for a cyclical accumulator 4B in FIG. 2B. The perimeter surface 6 of the cyclical accumulator 4 can rotate in a vertical plane, horizontal plane or any other plane disposed therebetween. The perimeter surface 6 of the cyclical accumulator 4 can also rotate clockwise or counterclockwise. In one embodiment of the present invention, shown in FIG. 1, the cyclical accumulator 4 preferably rotates in a vertical plane extending in a machine direction indicated by an arrow 10, clockwise indicated by an arrow 5, as viewed in FIG. 1. The term "machine direction" refers herein to the general direction in which the materials being processed move. The term "vertical plane" refers herein to a plane which is substantially perpendicular to a floor surface on which the machine 2 is disposed. The term "horizontal plane" refers herein to a plane which is substantially parallel to the floor surface. The perimeter surface 6 of the cyclical accumulator 4 is adapted to accumulate stacks of ribbons 12 (best seen in FIGS. 3 and 5).

The machine 2 of the embodiment shown in FIG. 1, may further comprise folding devices 14 and 16, which are preferably disposed adjacent to the perimeter surface 6 of the cyclical accumulator 4 to provide the ribbons 12 for accumulating the ribbons 12 on the perimeter surface 6. It should be noted that the number of folding devices to provide ribbons 12 can vary. The first folding device 14 is provided with a first web material 18 from a parent roll 20 which is preferably disposed on a first unwind stand 22. Similarly, the second folding device 16 is provided with a second web material 24 from a parent roll 26 which is preferably disposed on a second unwind stand 28. The unwind stands 22 and 28 can be of any suitable type used in the art.

Prior to introducing webs 18 and 24 to their respective folding devices 14 and 16, the webs 18 and 24 are preferably pulled from the respective parent rolls 20 and 26, under a suitable tension, by respective metering devices 30 and 32. The webs 18 and 24 are preferably aligned in relation to each other by respective aligning devices 34 and 36. The metering devices 30, 32 and the aligning devices 34, 36 can be any suitable devices used in the art.

The webs 18, 24 are optionally provided with a liquid composition by respective applicators 38 and 40. The applicators 38, 40 can be of any type used in the art suitable to provide a desired amount and/or pattern of the liquid composition to the webs 18, 24, and can include spray applicators, roll applicators, printing devices (e.g., glexographic printing), coating devices (e.g., gravure coating or flood coating), etc. Liquid compositions can include aqueous or non-aqueous solutions, emulsions, or suspensions comprising active or non-active ingredients, stability agents, fungal agents, antibacterial agents, skin protectors, fragrances, etc. Examples of suiable liquid compositions are disclosed in pending patent application Ser. Nos. 09/424476 and 09/424374, both of which are incorporated by reference herein.

Folded Ribbons and their Configurations

Figure 8:
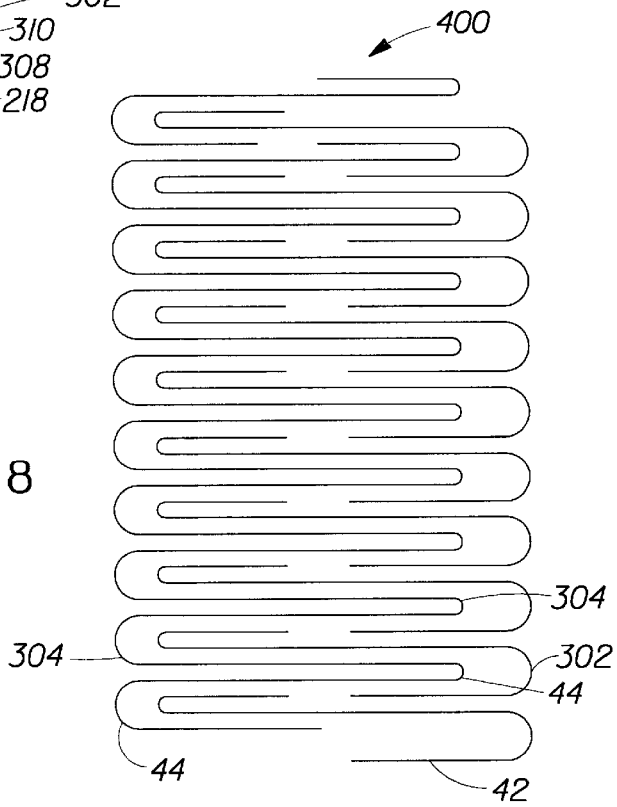
FIG. 8 is a cross-sectional view of a stack of ribbons, in interfolded configuration, taken along cut line 8—8 of FIG. 5.
Figure 8A:
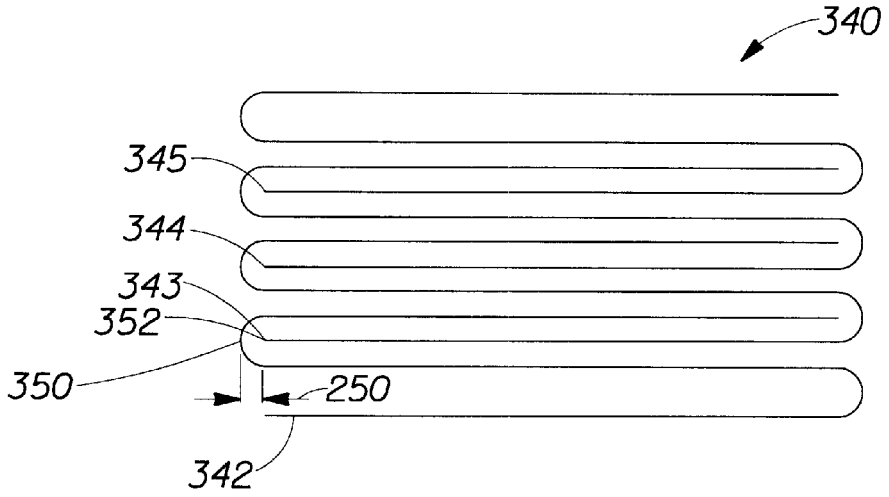
FIG. 8A is cross-sectional view of an alternative embodiment of a stack of folded sheets, wherein all of the sheets have a right-hand Z-fold configuration and adjacent sheets are interleaved or interfolded with each other.
Figure 8B:
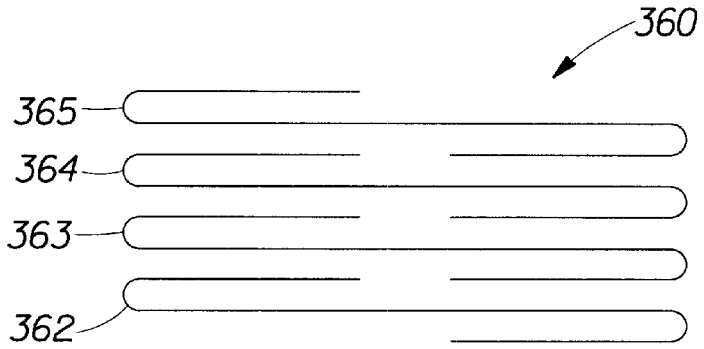
FIG. 8B is a cross-sectional view of an alternative embodiment of a stack of folded sheets, wherein all of the sheets have a right-hand Z-fold configuration and adjacent sheets are not interfolded with each other.

The webs 18, 24 preferably enter the respective folding devices 14, 16 in generally flat condition, and exit these folding devices as folded ribbons 42, 44, respectively (see FIG. 2). The folded ribbons 42, 44 can be of any folding configuration suitable to produce any configuration of stacks of folded sheets, non-limiting examples of which are disclosed in pending patent application Ser. Nos. 09/424476 and 09/424374, both of which are incorporated by reference herein. However, for the purpose of simplicity, the present invention will be described for the ribbons 42, 44 having a Z-fold configuration, as viewed in the machine direction and shown in FIG. 6, wherein the first ribbon 42 has a right-hand Z-fold configuration, and the second ribbon 44 has a left-hand Z-fold configuration. The term "right-hand" Z-fold configuration refers herein to a ribbon having an upper fold portion 210 folded to the right as viewed in the machine direction. Similarly, the term "left-hand" Z-fold configuration refers herein to a ribbon having an upper fold portion 230 folded to the left as viewed in the machine direction. However, it should be understood by one skilled in the art, that the stack of folded sheets can include sheets having only one-hand (i.e., right or left-hand) folded configuration. For example, FIGS. 8A and 8B show a stack 340 and 360, respectively, wherein each stack has a right-hand Z-fold configuration. However, in the stack 340, the adjacent folded sheets are interleaved or interfolded with each other, and in the stack 360, the adjacent folded sheets are not interfolded.

Figure 6:
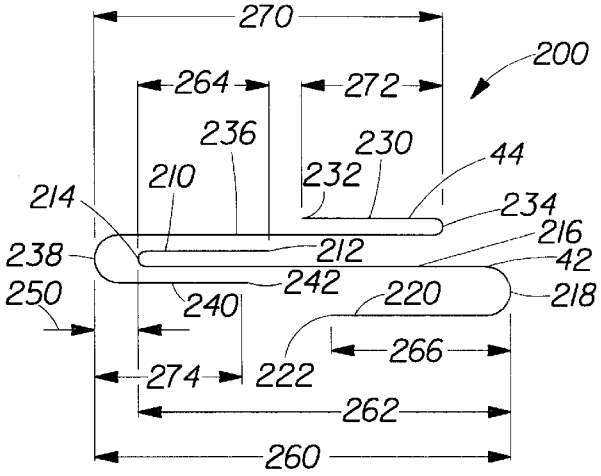
FIG. 6 is a cross-sectional view of the first pair of ribbons, in interfolded configuration, taken along cut line 6—6 of FIG. 2.

FIG. 6 illustrates the first ribbon 42 interfolded with the second ribbon 44 forming a first pair of ribbons 200. The first ribbon 42 comprises an upper fold portion 210 having a first free longitudinal edge 212 and a first folded longitudinal edge 214, wherein the first free longitudinal edge 212 is located to the right of the first folded longitudinal edge 214. The first folded longitudinal edge 214 is formed by folding a middle portion 216 under the upper fold portion 210. The middle portion 216 extends from the first folded longitudinal edge 214 to a second folded longitudinal edge 218, which is formed by folding a lower fold portion 220 under the middle portion 216. The lower fold portion 220 includes a second free longitudinal edge 222 located to the left of the second fold longitudinal edge 218. Similarly to the first ribbon 42, the second ribbon 44 comprises an upper fold portion 230, a first free longitudinal edge 232, a first folded longitudinal edge 234, a middle portion 236, a second folded longitudinal edge 238, a lower fold portion 240 and a second free longitudinal edge 242. However, contrary to the first ribbon 42, in the second ribbon 44, the first free longitudinal edge 232 is located to the left of the first folded edge 234, and the second free longitudinal edge 242 is located to the right of the second folded edge 238.

As illustrated in FIG. 6, the first ribbon 42 is interfolded with the second ribbon 44, such that the upper fold portion 210 and the middle portion 216 of the first ribbon 42 are disposed between the middle portion 236 and the lower fold portion 240 of the second ribbon 44, such that the upper fold portion 210 of the first ribbon 42 faces the middle portion 236 of the second ribbon 44 and forms a corner gap 250 between the first folded longitudinal edge 214 of the first ribbon 42 and the second folded longitudinal edge 238 of the second ribbon 44. However, it should be understood by one skilled in the art that the corner gap 250 can be formed not only between folded longitudinal edges 214 and 238, as shown in FIG. 6, but also between a folded longitudinal edge 350 and a free longitudinal edge 352, as shown, for example, in FIG. 8A. It should be also understood by one skilled in the art that the direction of the folds of the ribbons 42, 44 can be reversed so that corresponding folds are folded in directions opposite to the directions described above.

As illustrated in FIG. 6, the first pair of ribbons 200 has a width 260 extending between the second folded longitudinal edge 218 of the first ribbon 42 and the second folded longitudinal edge 238 of the second ribbon 44. The first ribbon 42 has a first ribbon width 262 extending between the first and second folded longitudinal edges 214 and 218, respectively; an upper folded portion width 264 extending between the first folded longitudinal edge 214 and the first free longitudinal edge 212; and a lower folded portion width 266 extending between the second folded longitudinal edge 218 and the second free longitudinal edge 222. Similarly, the second ribbon 44 has a second ribbon width 270; an upper folded portion width 272; and the lower folded portion width 274. It should be understood by one skilled in the art that the above widths can take various dimensions and proportions. The non-limiting examples of such variations may include ribbons having the upper fold portion width which is smaller than and/or equal to the middle portion width. Further, the upper fold portion width may be smaller than, equal to and/or larger than the lower folded portion width. Further, the width of the first ribbon 42 may be smaller than, equal to and/or larger than the width of the second ribbon 44.

The first pair of ribbons 200 including the ribbons 42 and 44 as illustrated in FIG. 6, can be provided by the first and second folding devices 14 and 16, as shown in FIG. 2. FIG. 6 is a cross-sectional view of the first pair of ribbons 200 taken along a cut line 6—6 of FIG. 2, perpendicularly to and in the direction of the path of travel 57. The first folding device 14 is a right-hand folding device, and the second folding device 16 is a left-hand folding device. The term "right-hand" folding device refers to a folding device which folds a ribbon having a right-hand Z-fold configuration as it was defined above. Similarly, the term "left-hand" folding device refers to a folding device which folds a ribbon having a left-hand Z-fold configuration as it was defined above. The folding devices 14, 16 are preferably positioned in proximity to each other such that the first ribbon 42, after being folded by the first folding device 14, passes through the second folding device 16, wherein the first ribbon 42 is interfolded with the second ribbon 44 folded by the second folding device 16.

Folding Devices

It should be noted, that the right and left-hand Z-fold configurations of ribbons 42 and 44, respectively, can be provided by conventional folding devices. However, in a preferred embodiment of the present invention, the ribbons 42 and 44 are folded by their respective folding devices 14 and 16, in accordance with the present invention, to provide higher efficiency and reliability of folding web materials, and particularly, wet web materials, moving at high linear velocities, and more particularly, of wet materials used in high-speed production of wipes. The right and left-hand folding devices 14 and 16, respectively, can be mirror images of each other. Therefore, for the purpose of simplicity, the folding devices 14 and 16 of the present invention will be described in more detail in terms of preferred and alternative embodiments of the right-hand or first folding device 14, as shown in FIGS. 9–16.

Referring to FIGS. 9–16, the first folding device 14 includes a first planar part 50, which includes a first planar surface 52 and a first relief surface 54, which is depressed in relation to the first planar surface 52. The first planar surface 52 provides a first folding edge 56 extending transversely across the path of travel 57 of the first web 18. The term "path of travel" refers to the general direction in which a web material being processed moves. The first folding edge 56 has a first end point 58 and a second end point 60, which are disposed respectively in a first vertical marginal plane 62 and a second vertical marginal plane 64. The vertical marginal planes 62 and 64 are generally parallel to the path of travel 57. The first planar surface 52 additionally provides a second folding edge 66 and a third folding edge 68, extending from the first and second end points 58 and 60, respectively, downwardly and rearwardly relative to the path of travel 57. The folding edges 66 and 68 are downwardly divergent relative to each other, providing a generally trapezoidal shape which includes a first folding angle 70 and a second folding angle 72. The first folding angle 70 is formed between the second folding edge 66 and the path of travel 57, and the second folding angle 72 is formed between the third folding edge 68 and the path of travel 57. The folding angles 70 and 72 can vary depending on suitable length of the first planar part 50 and/or suitable characteristics of the web to be folded. In one embodiment of the present invention, the first folding angle 70 is preferably between about 5 degrees and about 80 degrees and more preferably is about 24 degrees. The second folding angle 72 is preferably about 5 degrees and about 80 degrees and more preferably is about 19 degrees.

Figure 13:
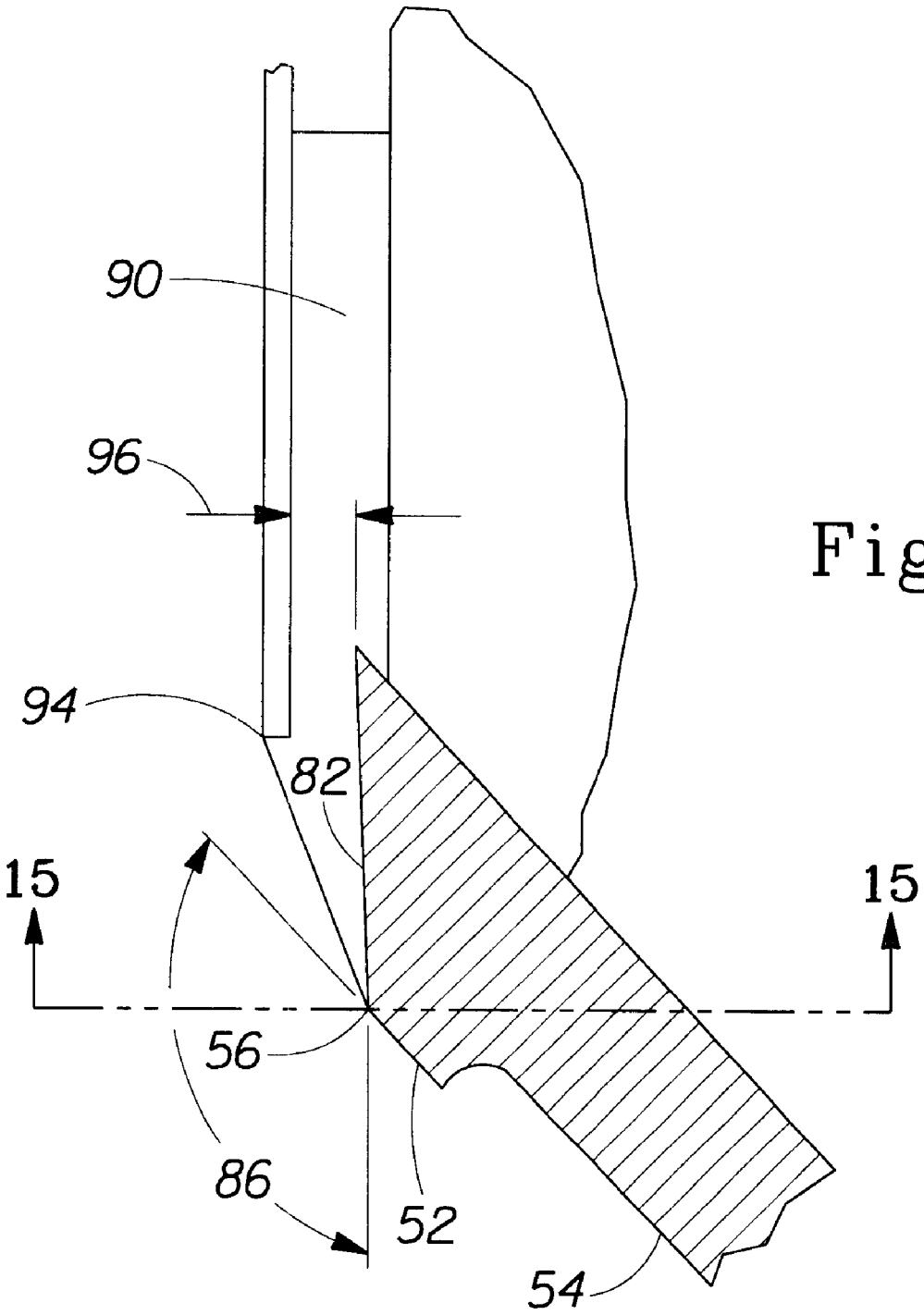
FIG. 13 is a cross-sectional view of the folding device of FIG. 9, taken along cut line 13—13, parallel to the path of travel of the web.

Referring to FIG. 13, the first planar part 50 further includes a second planar surface 82 extending forwardly from first folding edge 56 in the path of travel 57. The first planar surface 52 and second planar surface 82 form a third folding angle 86. The third folding angle 86 can vary, depending upon available space to accommodate the length of folding device in the path of travel 57 and/or particular characteristics of the web material. In one embodiment of this invention, the third folding angle 86 is preferably between about 5 degrees and about 175 degrees, and more preferably is about 122 degrees.

Figure 9:
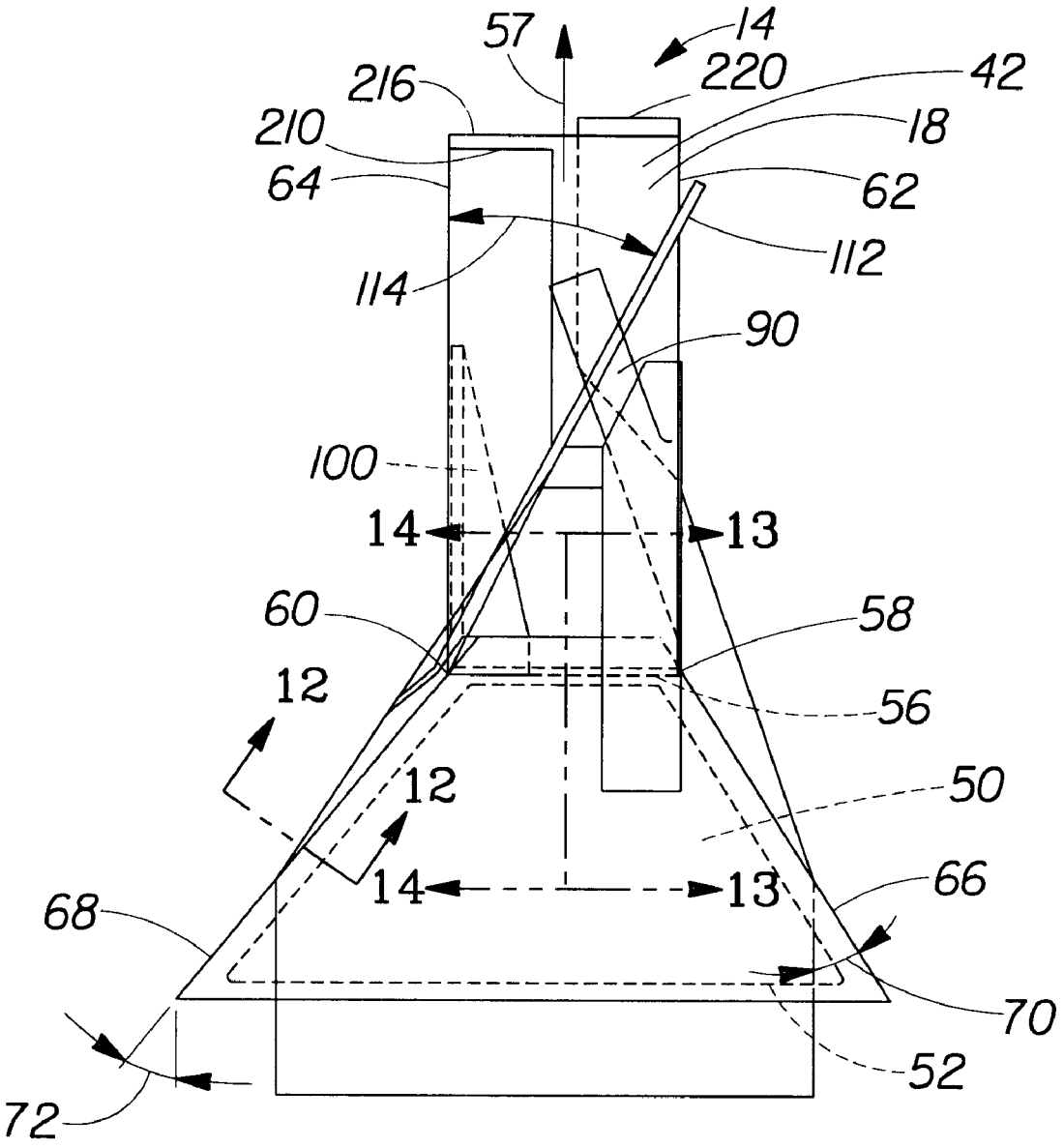
FIG. 9 is a side elevational view of a first folding device of FIG. 1, taken in the machine direction.
Figure 10:
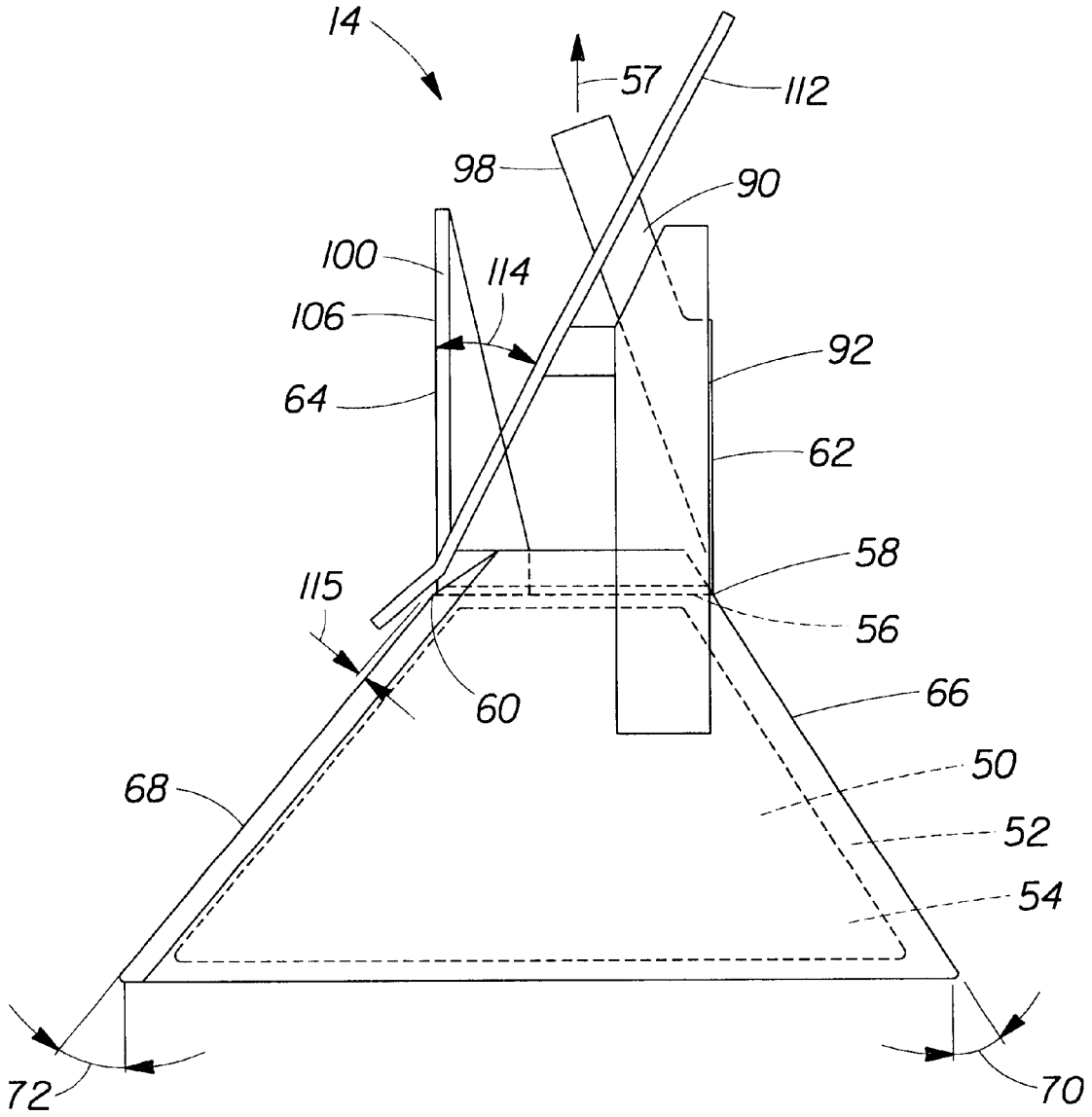
FIG. 10 is a side elevational view of the folding device of FIG. 9, showing no web material.
Figure 12:
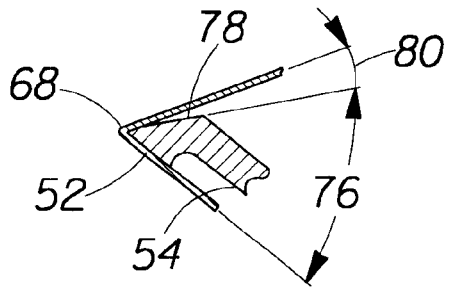
FIG. 12 is a cross-sectional view of the folding device of FIG. 9, taken along cut line 12—12.

Referring to FIGS. 9 and 12, the third folding edge 68 preferably includes a relief angle 76 formed between the first planar surface 52 and a second relief surface 78. The relief angle 76 can vary and is preferably sufficient to create a space angle 80 between the relief angle 76 and the first web 18, as the first web 18 wraps around the third folding edge 68. In one preferred embodiment of the present invention, the relief angle 76 is preferably between about 10 degrees and about 170 degrees, and more preferably about 50 degrees. The space angle 80 is preferably greater than zero degrees and more preferably is about 10 degrees.

Figure 11:
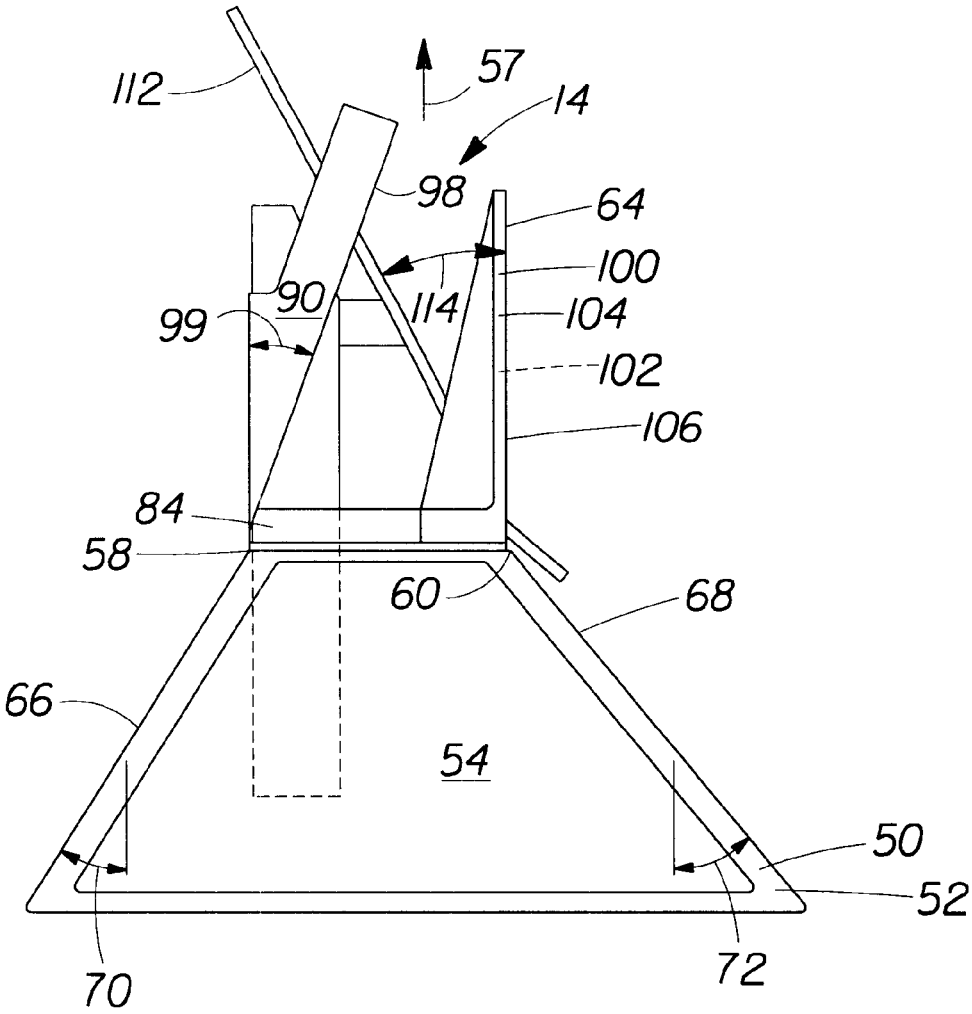
FIG. 11 is a side elevational view of a first folding device of FIG. 1, taken opposite to the machine direction and showing no web material.

Referring to FIG. 11, the first folding device 14 further includes a second planar part 90, which preferably has a general triangular shape and extends forwardly in the path of travel 57 from first end point 58, and generally parallel to the second planar surface 82 (best seen in FIG. 13). The second planar part 90 includes a fourth folding edge 92 extending forwardly in the path of travel 57 from a third end point 94, which is located in the first marginal plane 62 and is separated by an interfolding gap 96 extending downwardly from the first end point 58 (best seen in FIGS. 13 and 15). The interfolding gap 96 is sufficient to provide interfolding of ribbons described in more detail below herein. The second planar part 90 further includes a fifth folding edge 98, extending from the third end point 94 diagonally and forwardly relative to the path of travel 57 and forming a fourth folding angle 99 with the fourth folding edge 92. The fourth folding angle 99 depends upon the selected above folding angles, such as the first folding angle 70 and third folding angle 86, and in one embodiment of the present invention, the fourth folding angle 99 is preferably between about 5 degrees and about 50 degrees, and more preferably is about 20 degrees.

Referring to FIGS. 9–11, 13 and 16, the first folding device 14 further includes a third planar part 100, which preferably has a general triangular shape and extends forwardly in the path of travel 57 from the second end point 60 and generally parallel to the second planar surface 82. The third planar part 100 includes a third planar surface 102 and a fourth planar surface 104 opposed thereto (best seen in FIG. 16). The planar surfaces 102 and 104 form a seventh folding edge 106 extending forwardly in the path of travel 57 from the second end point 60 in the second vertical marginal plane 64. The third planar part 100 further preferably includes a third relief surface 108 and a fourth relief surface 110 opposed thereto (best seen in FIG. 16). The third relief surface 108 is preferably depressed in relation to the third plane surface 102, and the fourth relief surface 110 is preferably depressed in relation to the fourth plane surface 104.

Figure 14:
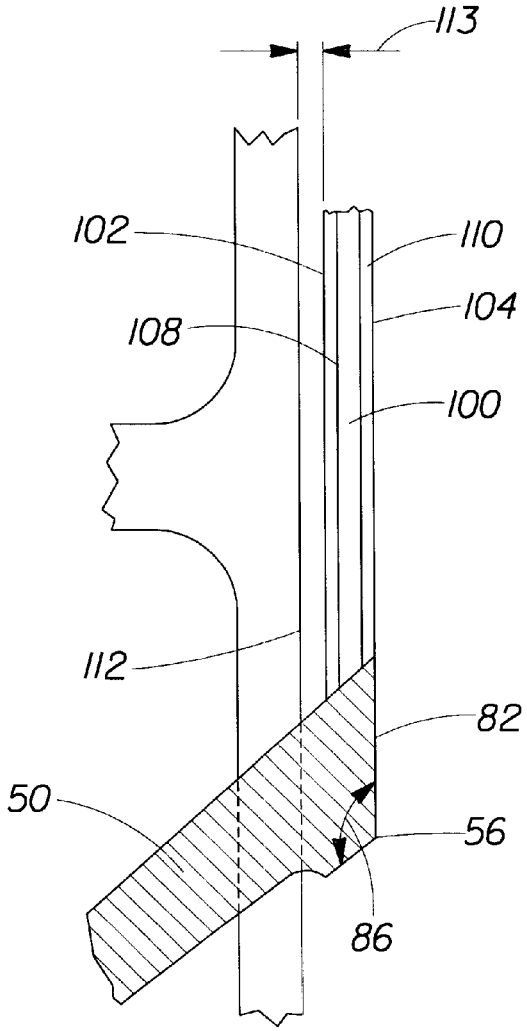
FIG. 14 is a cross-sectional view of the folding device of FIG. 9, taken along cut line 14—14, parallel to the path of travel of the web.
Figure 15:
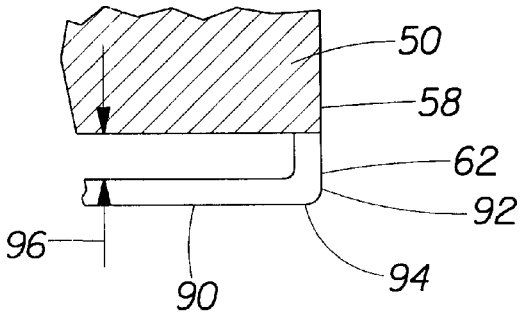
FIG. 15 is a cross-sectional view of a second planar part of the folding device of FIG. 13, taken along cut line 15—15, perpendicular to the path of travel of the web.
Figure 16:
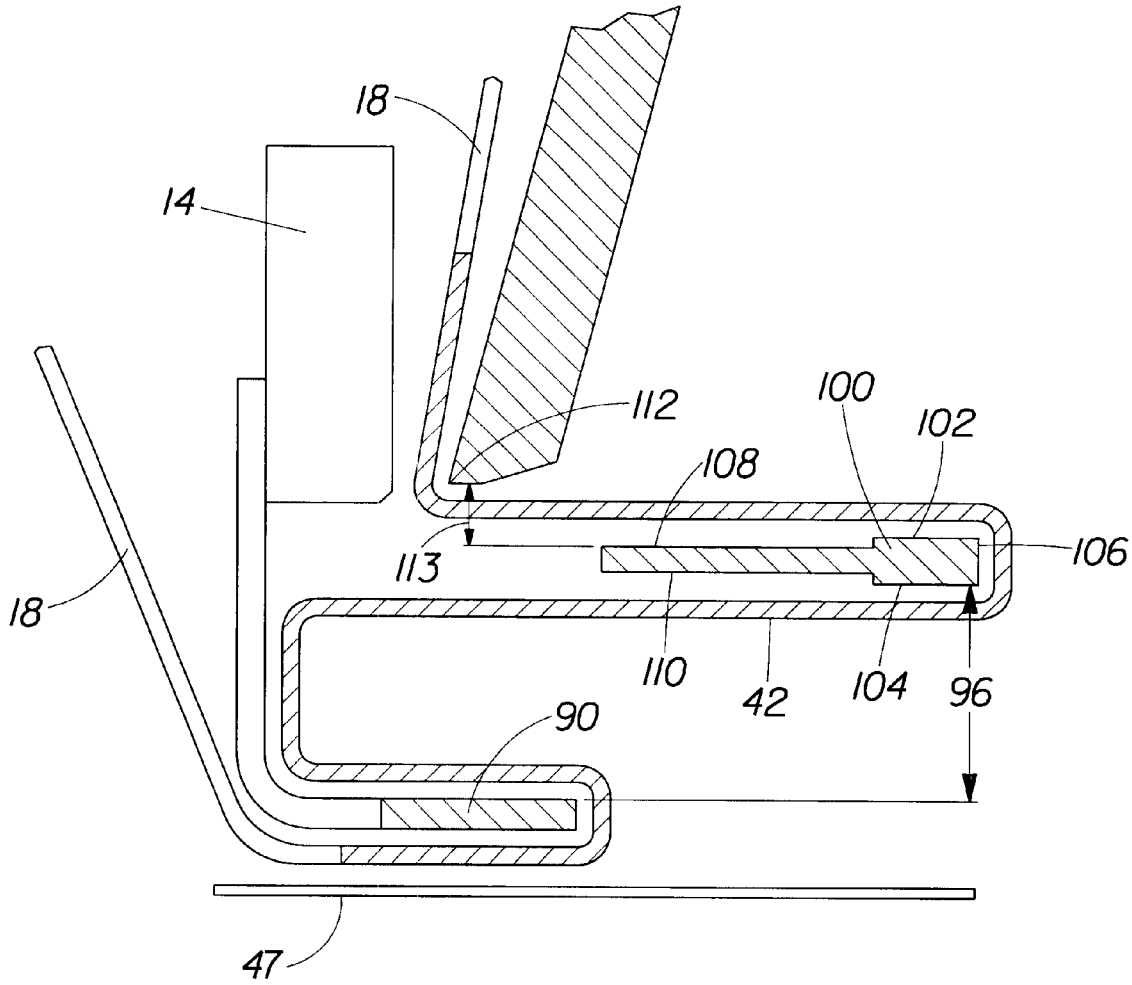
FIG. 16 is a cross-sectional view of the formation of the first ribbon by the first folding device of FIG. 2, taken along cut line 16—16, perpendicular to the path of travel of the web and opposite thereto.

Referring to FIGS. 9–11, 13 and 16, the first folding device 14 further includes a sixth folding edge 112 extending from the second vertical marginal plane 64 diagonally across the path of travel 57 towards the first vertical marginal plane 62 and forming a first gap 113 with the third planar part 100, sufficient for the web 18 to pass between the six folding edge 112 and the third planar part 100 as best seen in FIGS. 14 and 16. The sixth folding edge 112 forms a fifth folding angle 114 with the second vertical marginal plane 64. The fifth folding angle 114 depends upon the selected above folding angles, such as the second folding angle 72 and third folding angle 86, and in one embodiment of this invention, the fifth folding angle 114 is preferably about 28 degrees. The sixth folding edge 112 is preferably positioned adjacent to the second end point 60 to form a second gap 115 (see FIG. 10), which is suitable for the web to pass between the six folding edge 112 and the third folding edge 68. The sixth folding edge 112 is preferably disposed generally parallel to the third planar surface 102 of the third planar part 100 (see FIG. 16).

Operation

Figure 17:
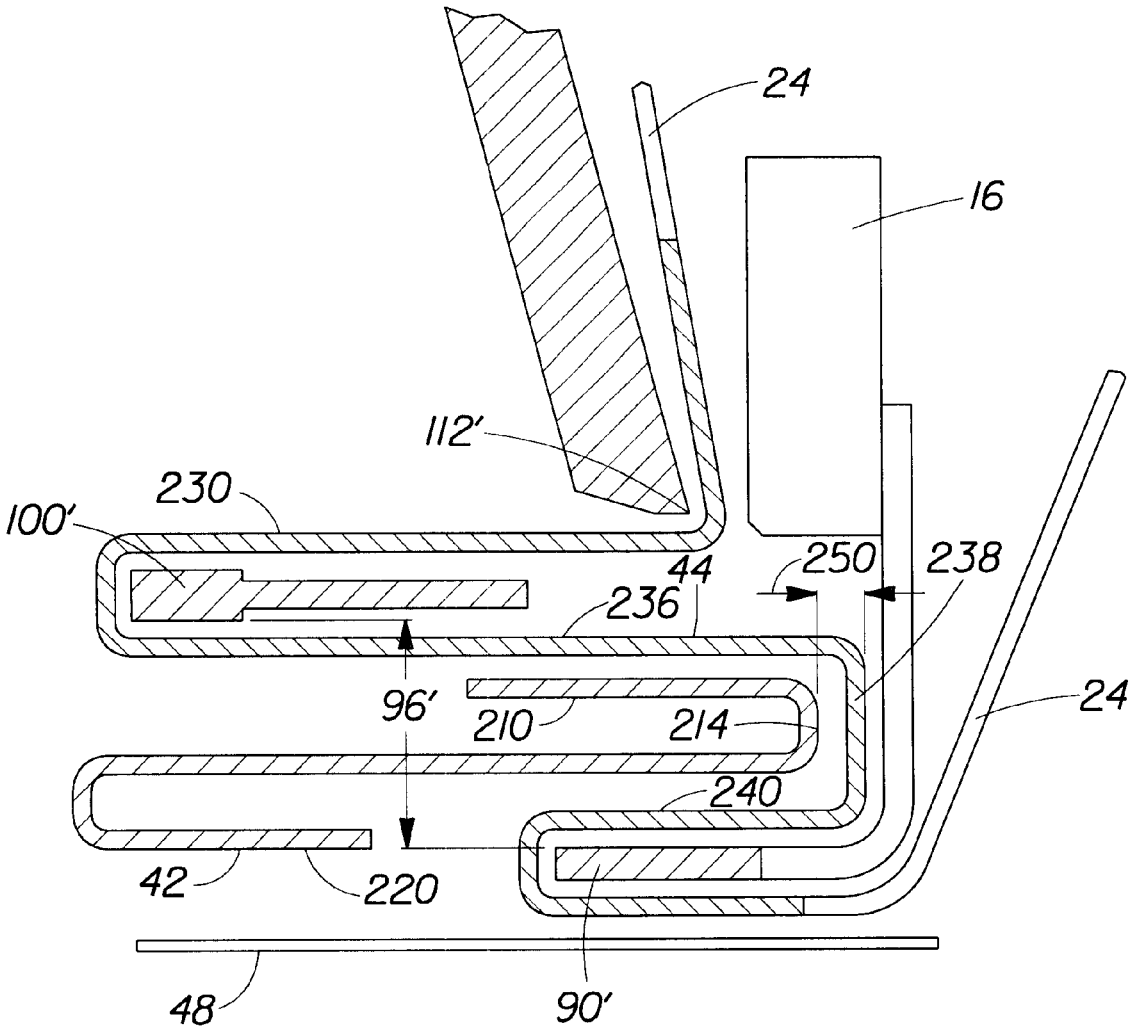
FIG. 17 is a cross-sectional view of the formation of the second ribbon by the second folding device of FIG. 2, taken along cut line 17—17, perpendicular to the path of travel of the web and opposite thereto.

Referring to FIG. 2, illustrating a front elevational view of the cyclical accumulator 4 at a first arresting position 11. The term "first arresting position" as used herein, means a position of the cyclical accumulator 4 to enable an operator to secure the ribbons 42, 44 to the perimeter surface 6 of the cyclical accumulator 4 after the ribbons 42, 44 are formed by their respective folding devices 14, 16. It has been found that the first arresting position being a stationary position is especially useful for the operator. The first arresting position can be any position of the cyclical accumulator 4 suitable to the operator to secure one or more ribbons to the perimeter surface 6 of the cyclical accumulator 4. (It should be understood by one skilled in the art that when a single folding device is used to provide a single ribbon for accumulating onto the cyclical accumulator 4, a single ribbon will be secured by the operator to the cyclical accumulator 4 at the first arresting position.) FIG. 16 illustrates the formation of the first ribbon 42 in the first folding device 14, and FIG. 17 illustrates the formation of the second ribbon 44 in the second folding device 16. In addition, FIG. 17 illustrates the interfolding of the first ribbon 42 with the second ribbon 44 in the second folding device 16. The interfolding is provided by threading the first ribbon 42 through an interfolding gap 96' of the second folding device 16, wherein the upper fold portion 210 and the middle portion 216 of the first ribbon 42 are inserted between the middle portion 236 and the lower fold portion 240 of the second ribbon 44.

The interfolded ribbons 42 and 44 are positioned onto and secured to the perimeter surface 6 of the cyclical accumulator 4. The ribbons 42 and 44 are preferably positioned onto the perimeter surface 6 such that the first ribbon 42 is in contacting relationship with the perimeter surface 6, and the second ribbon 44 is in an overlying relationship with the first ribbon 42. The term "contacting relationship" herein includes a direct contact or indirect contact through one or more intermediate surfaces of at least a portion of the first ribbon 42 to the perimeter surface 6 of the cyclical accumulator 4. The ribbons 42, 44 can be secured to the perimeter surface 6 by any device or means (mechanical, vacuum, pneumatic, hydraulic, electromechanical or combinations thereof) suitable to enable the cyclical accumulator 4 to provide a pulling force for the ribbons 42, 44 in the direction of rotation 5 of the cyclical accumulator 4. In one embodiment shown in FIG. 2, the ribbons 42, 44 are secured by a mechanical device 43 which ties the ends of ribbons 42, 44 extending from respective folding devices 14 and 16. After the ribbons 42 and 44 have been positioned onto and secured to the perimeter surface 6 of the cyclical accumulator 4, the cyclical accumulator 4 is rotated, in this example, clockwise 5, as shown in FIG. 3. During the rotation of the cyclical accumulator 4, the ribbons 42 and 44 are pulled by the cyclical accumulator 4 through the folding devices 14 and 16 to wrap the ribbons 42 and 44 around the perimeter surface 6 of the cyclical accumulator 4. The ribbons 42 and 44 form a first pair of ribbons 200 as shown in FIG. 3. The term "first pair" is meant herein a pair of ribbons 42, 44 formed during a first revolution of the cyclical accumulator 4.

After the first arresting position 11, the cyclical accumulator 4 is rotated approximately one revolution and is arrested again in a second arresting position 15, as illustrated in FIG. 3. The term "second arresting position" as used herein, means a position of the cyclical accumulator 4 to enable an operator to thread a second ribbon 44 through an interfolding gap 96 of the first folding device 14. It has been found that the second arresting position being a stationary position is especially useful for the operator. The second arresting position 15 can be any position of the cyclical accumulator 4 suitable to the operator to thread a second ribbon through the first folding device 14, as shown, for example, in FIG. 3A. The threading in the second arresting position 15 will be described in more detail herein below.

Figure 4:
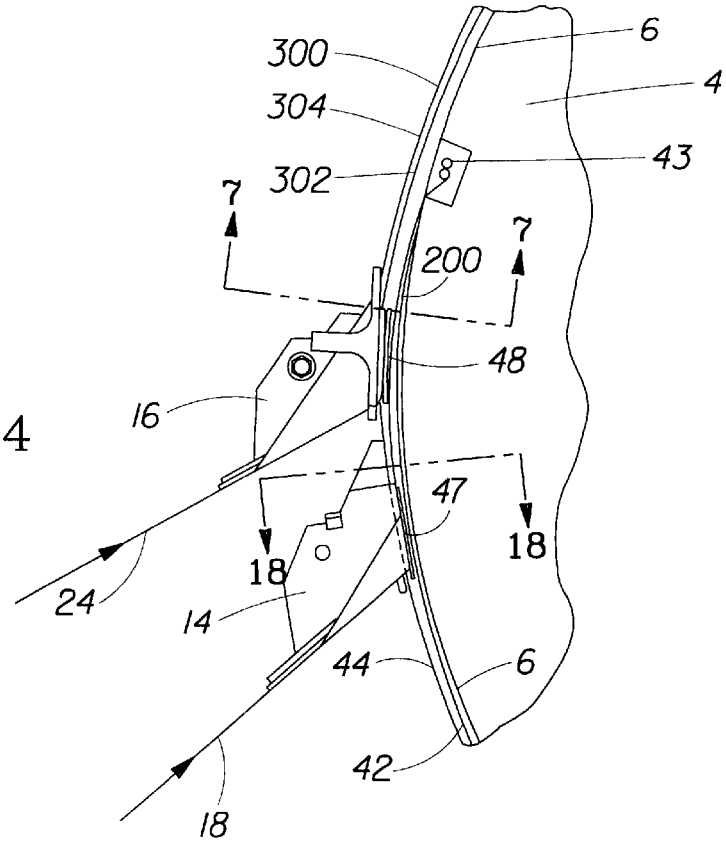
FIG. 4 is a view similar to FIG. 3A, showing a second pair of ribbons superimposing the first pair of ribbons.
Figure 7:
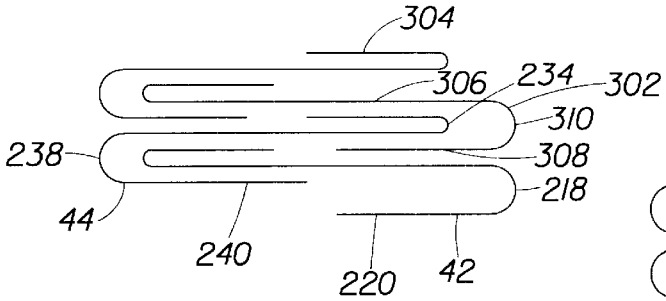
FIG. 7 is a cross-sectional view of the first and second pair of ribbons, in interfolded configuration, taken along cut line 7—7 of FIG. 4.
Figure 18:
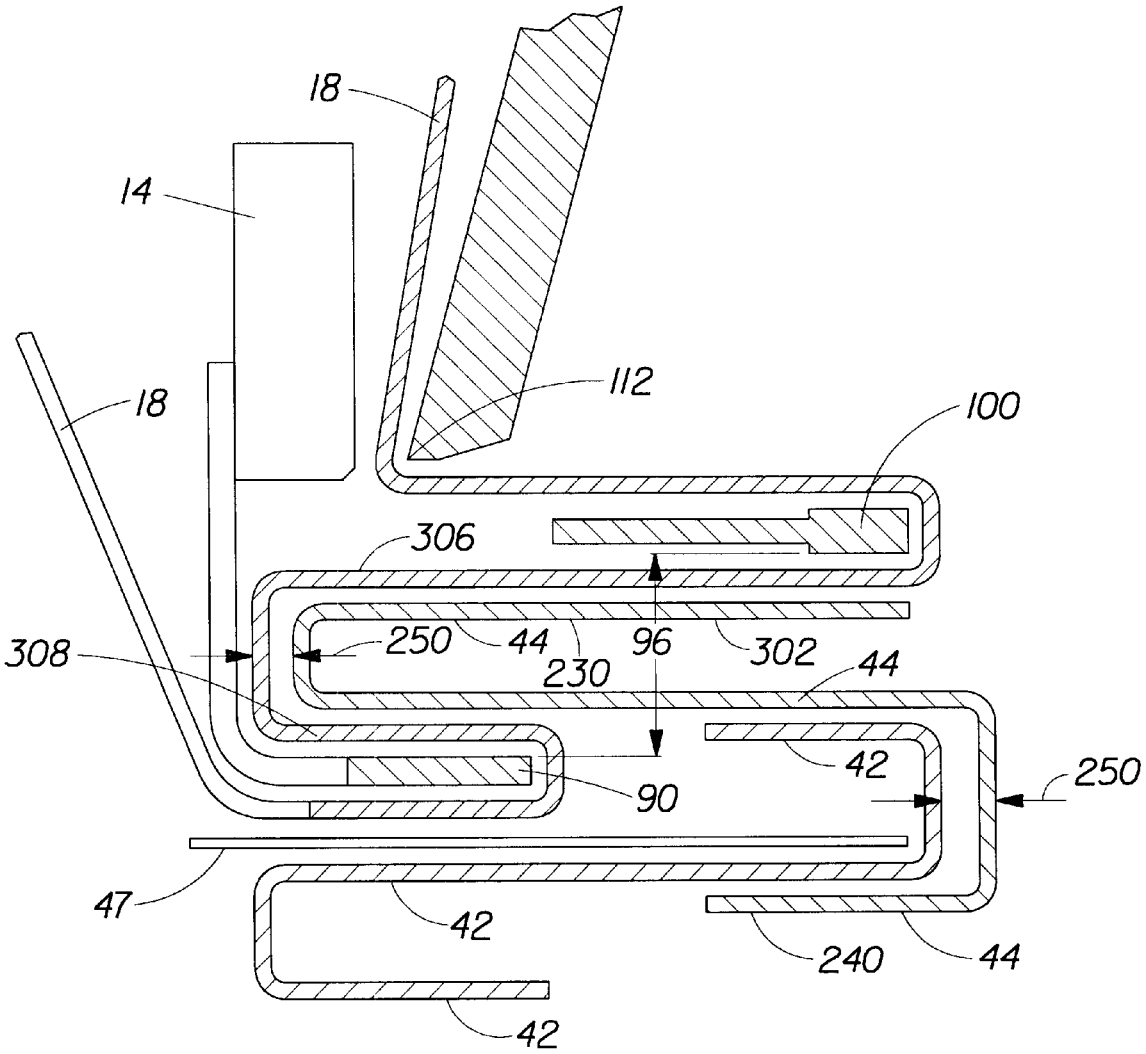
FIG. 18 is a cross-sectional view of the first folding device of FIG. 4, taken along cut line 18—18, perpendicular to the path of travel of the web and opposite thereto, showing a second ribbon in a threaded position in the first folding device.

When the first pair of ribbons 200 is wrapped around the perimeter surface 6, a second pair of ribbons 300 is superimposed onto the first pair of ribbons 200, as shown in FIG. 4. The second pair of ribbons 300 may include a first ribbon 302 and a second ribbon 304 formed by the first and second folding devices 14 and 16, respectively. In the second arresting position 15, the operator interfolds the second ribbon 44 of the first pair of ribbons 200 with the first ribbon 302 of the second pair of ribbons 300, as shown in FIGS. 7 and 18. The interfolding is provided by threading the second ribbon 44 through the interfolding gap 96 of the first folding device 14, wherein the upper folded portion 230 and the middle portion 236 of the second ribbon 44 are inserted between the middle portion 306 and the lower fold portion 308 of the first ribbon 302 in the first folding device 14.

Figure 5:
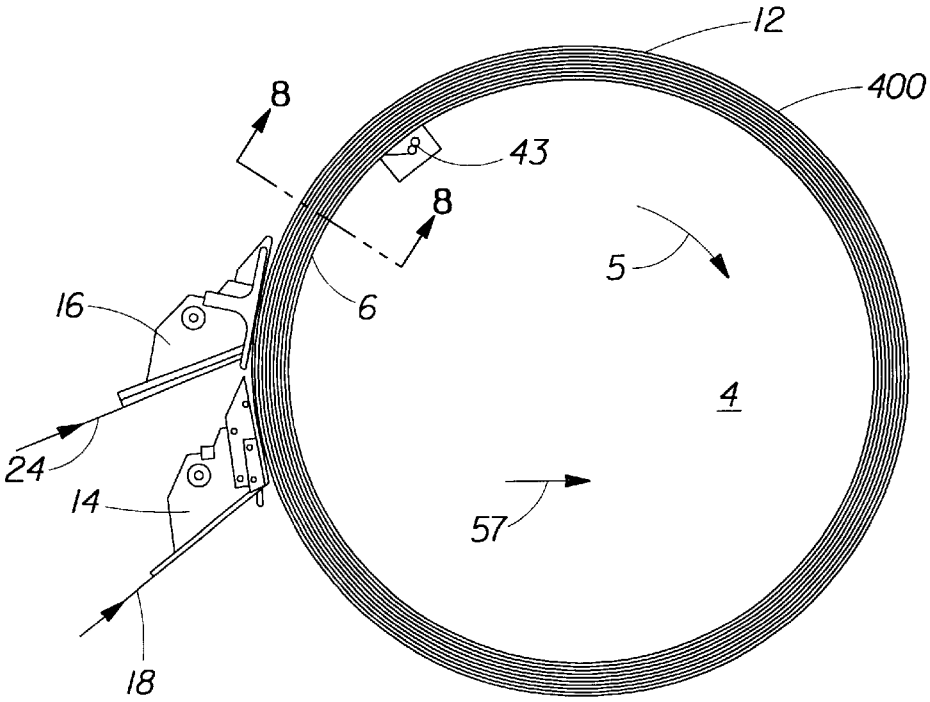
FIG. 5 is an enlarged front elevational view of the cyclical accumulator and two folding devices of FIG. 1, showing a stack of ribbons accumulated on the perimeter surface of the cyclical accumulator.

After the second arresting position 15, the cyclical accumulator 4 can start to cycle by rotating continuously to form a new pair of ribbons with each subsequent cycle and superimposing each new pair of ribbons onto the preceding ribbons accumulated onto the perimeter surface 6 during the preceding cycles of the cyclical accumulator 4. FIGS. 5 and 8 illustrate a stack of ribbons 400 accumulated on the perimeter surface 6 of the cyclical accumulator 4 after 10 cycles. The number of cycles and the corresponding number of pairs of ribbons can vary, typically from 1 to 50, providing a stack of 2 to 100 ribbons.

However, it should be understood by one skilled in the art that ribbons can be accumulated on the cyclical accumulator 4 not only in pairs but as single ribbons provided by a single folding device, especially, when all of the ribbons in the stack are one-handed, i.e., right-handed or left-handed. For example, FIG. 8A illustrates stack 340 including four ribbons 342, 343, 344 and 345, wherein all four ribbons have a right-hand Z-fold configuration and adjacent ribbons are interleaved or interfolded with each other. To provide the interfolded configuration of the ribbons in the stack 340, the operator may thread the second ribbon 343 through the interfolding gap 96 of the first or right hand folding device 14 in the second arresting position 15 after the first ribbon 342 has been accumulated on the perimeter surface 6 of the cyclical accumulator 4. It should be further understood that when folded sheets are not interleaved or interfolded, as shown, for example, in FIG. 8B, there is no need for the operator to thread a second ribbon through the interfolding gap 96, and accordingly, there is no need for a second arresting position 15 of the accumulator 4.

The rotation of the cyclical accumulator 4 can be provided and controlled by any means in the art suitable to maintain the tangential velocity of the outermost ribbon disposed on the perimeter surface 6 of the cyclical accumulator 4 substantially consistent and correspondent with the speed of advance of the webs 18 and 24 as they fed by the respective metering devices 30 and 32. Because with each cycle of the cyclical accumulator 4, the outermost ribbon, interposed onto a preceding ribbon, is disposed farther from the perimeter surface 6 of the cyclical accumulator 4, the angular velocity of the cyclical accumulator must be slowed down to provide the corresponding tangential velocity of the outermost ribbon consistent with the speed of advance of the webs 18 and 24. The angular velocity of the cyclical accumulator can be reduced in steps, at each fully or partially accomplished cycle, or continuously, when the tangential velocity of the outermost ribbon corresponds with the speed of advance of the webs 18, 24. It should be understood by one skilled in the art that the corresponding tangential velocity of the outermost ribbon on the perimeter surface 6 of the cyclical accumulator 4 can be different from the advanced speed of the webs 18, 24 depending upon the desired differences in draws or tensions between the outermost ribbon and the webs 18, 24. The differences in draw are typically greater than zero and can be up to 50% and more, preferably between about 1% and about 8%.

As a new outermost ribbon is disposed farther from the perimeter surface 6 of the cyclical accumulator 4, the cyclical accumulator 4 can be preferably displaced linearly in the machine direction 10 away from the folding devices 14 and 16 to provide a suitable space between the folding devices 14, 16 and the outermost layer of the newly formed ribbon(s). The displacement of the cyclical accumulator 4 can be preferably provided with each cycle of the cyclical accumulator 4 by employing any suitable means 316 for providing a linear motion 318, including a stepping-type motion or continuous motion. Possible examples of devices to provide linear motion 318 of the cycling accumulator 4 can include, but are not limited to, various linear actuators, fluid-powered cylinders, fluid-powered or electric motors including servo motors, linkages and combinations thereof. Alternatively, a suitable space between the folding devices 14, 16 and the outermost layer of the newly formed ribbon(s) on the perimeter surface 6 of the cyclical accumulator 4 can be provided by moving the folding devices 14, 16 away from the cyclical accumulator 4, providing that the needed tension of the webs 18, 24 is maintained.

The first and second folding devices 14, 16 may also include partition plates 47 and 48, respectively, to provide efficient, low friction formation of the lower portion of the ribbon, as shown in FIGS. 3, 3A, and 16–18, by preventing a relative lateral movement between the web forming the lower portion of the ribbon and the ribbons accumulated on the perimeter surface 6 of the cyclical accumulator 4. The partition plates 47 and 48 may be attached to their respective folding devices 14 and 16.

Figure 19:
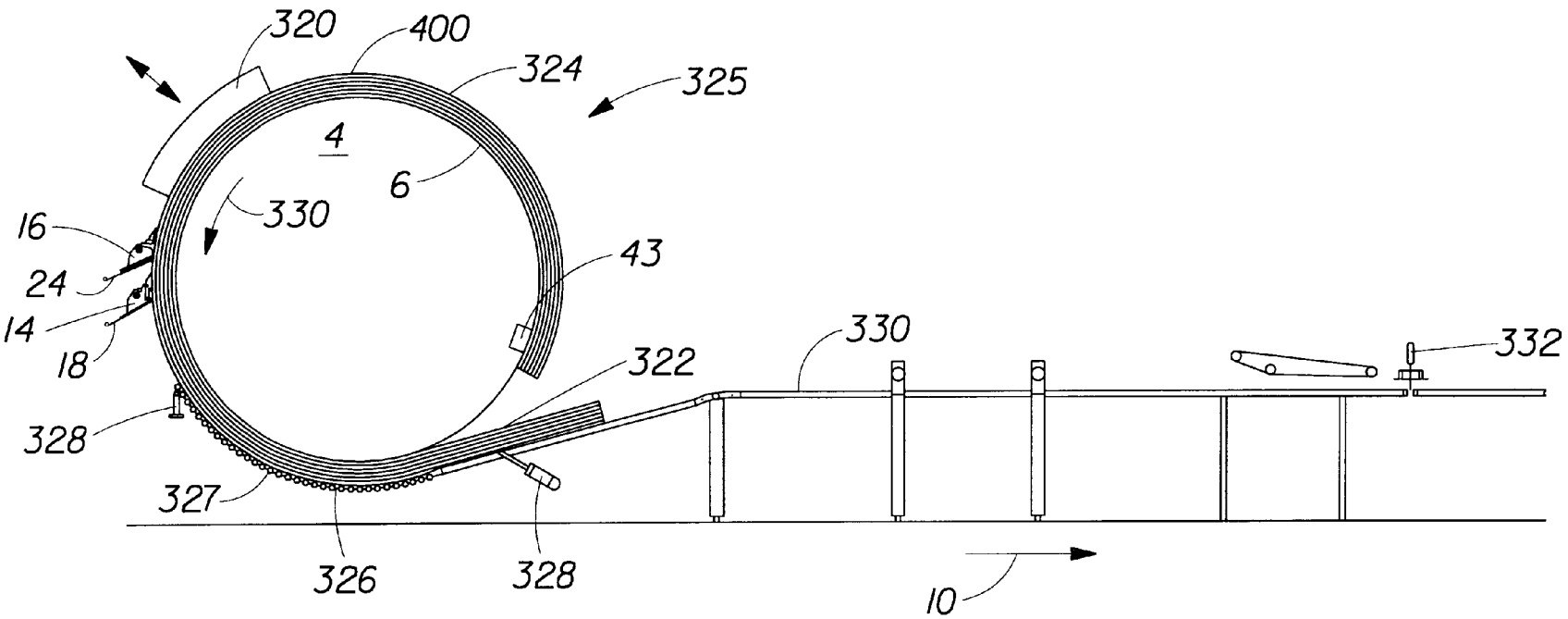
FIG. 19 is a simplified schematic front elevational view similar to FIG. 1, showing a cyclical accumulator in a third arresting position and, wherein a stack of ribbons is being unloaded from the cyclical accumulator onto a conveying surface.

After a desired number of ribbons has been accumulated on the perimeter surface 6 of the cyclical accumulator 4, the cyclical accumulator 4 is arrested at a third arresting position. The term "third arresting position" as used herein, means a position of the cyclical accumulator 4 to provide a convenient discharge of the accumulated stack of ribbons 400 from the perimeter surface 6 of the cyclical accumulator 4. It has been found that the third arresting position being a stationary position is especially useful for the operator. One example of the third arresting position 325 is shown in FIG. 19, wherein the mechanical device 43, which ties the ends of ribbons 42 and 44, is preferably arrested adjacent to a preferably retractable supporting surface 326. The stack of ribbons 400 is then cut preferably in a place adjacent to the means 43 through and across the width of the stack of ribbons 400 to severe the stack 400 into a first portion 322 and a second portion 324. The first portion 322 then can be laid down onto the retractable supporting surface 326, which can at least partially surround the cyclical accumulator 4 to support the stack of ribbons 400. The supporting surface 326 can be any surface to provide a low friction movement of the stack of ribbons 400 in relation to the supporting surface 326. One suitable example of providing the supporting surface 326, as shown in FIG. 19, includes a roller surface 327 retractable by air cylinders 328.

The second portion 324 of the stack of ribbons 400 can be held against the perimeter surface 6 by a preferably retractable hold-down device 320 suitable to provide both a desired force to hold the stack 400 against the perimeter surface 6 and a low friction movement of the stack 400 in relation to the holding device 320. The hold-down device 320 can be actuated by any means suitable to provide both the desired force and low friction movement. The hold-down force can be provided by suitable spring(s), fluid-actuated cylinder(s), electromechanical actuators, etc. The second portion 324 of the stack 400 can be laid down onto the supporting surface 326 by preferably rotating the cyclical accumulator 4, as shown in this example, counter-clockwise 330 until the stack of ribbons 400 is fully deposited onto the supporting surface 326.

The stack of ribbons 400 can then be indexed into a cutting device 332 to cut the stack of ribbons 400, generally across the width of the stack of ribbons 400, into separate stacks of folded sheets 334, as shown in FIG. 20. The cutting device 332 can be any cutting device suitable to provide a cut through the stack of ribbons 400, and can include circular or reciprocating saws, knives, liquid jet cutters, laser cutters, etc. Thus, a stack of folded ribbons 400 accumulated onto the perimeter surface 6 of the cyclical accumulator 4 can provide a certain batch production of stacks of folded sheets 334.

As soon as the second portion 324 of the stack of ribbons 400 is discharged from the perimeter surface 6, the cyclical accumulator can be brought into the first arresting position 1 again to start a new batch production of the stacks of folded sheets 334.

While particular embodiments and/or individual features of the present invention have been illustrated and described, it would be obvious to those skilled in the art that various other changes and modifications can be made without departing from the spirit and scope of the invention. Further, it should be apparent that all combinations of such embodiments and features are possible and can result in preferred executions of the invention. Therefore, the appended claims are intended to cover all such changes and modifications that are within the scope of this invention.

What is claimed is:

1. A folding device for folding a ribbon from a continuous web of material traveling along a path having folding margins, the folding device comprising:

(i) a first planar part including a first planar surface and a first relief surface depressed in relation thereto, the first planar surface having a generally trapezoidal shape providing a first folding edge extending transversely across the path of travel and having a first end point in a first vertical marginal plane of said path and a second end point in a second vertical marginal plane of said path, wherein the first and second vertical marginal planes are generally parallel to the path of travel, a second planar surface extending forwardly in the path of travel from the first folding edge, the trapezoidal shape of the first planar surface providing a second folding edge and a third folding edge, the second folding edge extending from the first end point and the third folding edge extending from the second end point, the third folding edge forming a relief angle between the first planar surface and a third relief surface sufficient to create a space angle between the third relief surface and the continuous web of material, wherein said third relief surface extends from said third folding edge;

(ii) a second planar part having a generally triangular shape and extending forwardly in the path of travel from the first end point and generally parallel to the second planar surface, the second planar part comprising:

a fourth folding edge extending forwardly in the path of travel from a third end point located in the first vertical marginal plane and separated downwardly by an interfolding gap from the first end point, and a fifth folding edge extending from the first end point diagonally forwardly relative to the path of travel and across the path of travel;

(iii) a third planar part having a generally triangular shape and extending from the second end point in the path of travel forwardly and generally parallel to the second planar surface, the third planar part comprising:

a third planar surface and a fourth planar surface opposed thereto, the third planar surface and the fourth planar surface forming a seventh folding edge extending forwardly in the path of travel in the second vertical marginal plane from the second end point, and a fourth relief surface and a fifth relief surface opposed thereto, the fourth relief surface being depressed in relation to the third plane surface, the fifth relief surface being depressed in relation to the fourth plane surface; and (iv) a sixth folding edge forming a first gap with the third planar part and a second gap with the second end point, the sixth folding edge extending from the second vertical marginal plane diagonally across the path of travel to the first vertical marginal plane and generally parallel to the third planar part.

* * * * *

UNITED STATES PATENT AND TRADEMARK OFFICE

CERTIFICATE OF CORRECTION

PATENT NO. : 6,599,228 B2
DATED : July 29, 2003
INVENTOR(S) : David A. Harnish

It is certified that error appears in the above-identified patent and that said Letters Patent is hereby corrected as shown below:

Title page,
Item [75], Inventors, delete "Kerri Crain Hailey, Cincinnati, Ohio (US); Jonathan Paul Brennan, Cincinnati, OH (US);".

Signed and Sealed this

Twenty-third Day of May, 2006

JON W. DUDAS
*Director of the United States Patent and Trademark Office*